US007621857B2

(12) United States Patent
Pompile

(10) Patent No.: US 7,621,857 B2
(45) Date of Patent: Nov. 24, 2009

(54) SHOULDER STABILIZING AND STRENGTHENING APPARATUS

(76) Inventor: Domenic J. Pompile, 21090 Water Oak Ter., Boca Raton, FL (US) 33428

( * ) Notice: Subject to any disclaimer, the term of this patent is extended or adjusted under 35 U.S.C. 154(b) by 182 days.

(21) Appl. No.: 11/977,242

(22) Filed: Oct. 24, 2007

(65) Prior Publication Data

US 2008/0058182 A1 Mar. 6, 2008

Related U.S. Application Data

(63) Continuation-in-part of application No. 11/199,728, filed on Aug. 9, 2005, now abandoned.

(51) Int. Cl.
*A63B 23/02* (2006.01)
*A63B 21/02* (2006.01)

(52) U.S. Cl. ..... 482/129; 482/44

(58) Field of Classification Search ..... 482/44, 482/46, 129, 905

See application file for complete search history.

(56) References Cited

U.S. PATENT DOCUMENTS

| | | | | | |
|---|---|---|---|---|---|
| 4,592,545 | A | * | 6/1986 | Sagedahl et al. | 482/7 |
| 4,669,451 | A | * | 6/1987 | Blauth et al. | 601/33 |
| 4,730,829 | A | * | 3/1988 | Carlson | 482/5 |
| 4,772,015 | A | * | 9/1988 | Carlson et al. | 482/92 |
| 4,773,398 | A | * | 9/1988 | Tatom | 601/34 |
| 4,784,385 | A | * | 11/1988 | D'Angelo | 482/111 |
| 4,817,943 | A | | 4/1989 | Pipasik | |
| 4,944,508 | A | | 7/1990 | Collins | |
| 5,039,091 | A | * | 8/1991 | Johnson | 482/64 |
| 5,058,574 | A | | 10/1991 | Anderson et al. | |
| 5,080,350 | A | * | 1/1992 | Schofield et al. | 482/132 |
| 5,152,733 | A | * | 10/1992 | Farenholtz et al. | 482/135 |
| 5,158,074 | A | * | 10/1992 | Grellas | 601/24 |
| 5,179,939 | A | | 1/1993 | Donovan et al. | |
| 5,755,650 | A | * | 5/1998 | Urso | 482/138 |
| 5,957,816 | A | * | 9/1999 | Staffa | 482/70 |
| 6,007,500 | A | * | 12/1999 | Quintinskie, Jr. | 601/5 |
| 6,277,030 | B1 | * | 8/2001 | Baynton et al. | 473/219 |
| 2006/0003875 | A1 | * | 1/2006 | Sharps | 482/100 |

FOREIGN PATENT DOCUMENTS

FR 2585958 A1 * 2/1987

* cited by examiner

*Primary Examiner*—Loan H Thanh
*Assistant Examiner*—Victor K Hwang
(74) *Attorney, Agent, or Firm*—Peter J. Van Bergen

(57) ABSTRACT

A shoulder exercising apparatus has a motion assembly defined by a stacked arrangement of first, second and third stages. The first stage is coupled to the second stage to permit relative one-dimensional straightline motion therebetween. The third stage is coupled to the second stage to permit relative in-plane rotational motion therebetween. The motion assembly further includes means for selectively limiting the relative one-dimensional straightline motion and the relative in-plane rotational motion. A handle coupled to the third stage is grasped by a user. A base assembly is coupled to the first stage of the motion assembly for positioning the motion assembly at a selected vertical height, a selected pitch position, and a selected yaw position.

20 Claims, 12 Drawing Sheets

SHOULDER STABILIZING AND STRENGTHENING APPARATUS

This is a continuation-in-part of application Ser. No. 11/199,728, filed Aug. 9, 2005, and now abandoned. Pursuant to 35 U.S.C. §120, the benefit of priority from co-pending application ser. No. 11/199,728 is hereby claimed for this application.

FIELD OF THE INVENTION

The invention relates generally to shoulder strengthening and rehabilitation apparatus, and more particularly to an adjustable apparatus that can stabilize the shoulder and rotator cuff thereby allowing an individual to optimize their shoulder range of motion strength, and that can provide for self myofascial release techniques to decrease spasm.

BACKGROUND OF THE INVENTION

It can be appreciated that shoulder strengthening and rehabilitation apparatus have been in use for years. These apparatus are used for the development of the rotator cuff musculature of a user by isolating the head of the humerus in the glenoid cavity during internal and external rotation. The main problem with conventional shoulder rehabilitation apparatus is that they do not stabilize the shoulder in the most optimal position for strengthening the rotator cuff muscles. In particular, existing apparatus do not allow for resisted scapular retraction as well as adduction of the arm while fixated at 90 degrees, nor do they provide for resisted shoulder internal and external rotation. Also, the prior art does not allow for scapular depression when the arm is at 90 degrees of shoulder abduction. Further, the prior art does not accommodate resisted internal rotation which is usually twice as strong as that of external rotation.

Some exemplary prior art machines include U.S. Pat. No. 4,817,943 that allows for strengthening of the shoulder muscles, but does not allow for mobility and stabilization of the glenohumeral joint which is essential in order to optimally strengthen the rotator cuff. The apparatus disclosed in U.S. Pat. No. 4,944,508 fails to teach the user to maintain a 90 degree angle of the arm and also has to be stabilized to a solid surface, such as a table. In addition, the prior art fails to provide proper stabilization of the humerus and also the availability to stabilize the shoulder blade, while strengthening the rotator cuff with interchangeable levels of the resistances. The disclosure in U.S. Pat. No. 5,058,574 is mainly concerned with fixating the position of the lower arm, rather than allowing for the proper stabilization of the scapula and the humerus which meet to form the shoulder joint.

Another shortcoming in the various apparatus of the prior art is the absence of myofascial release to the pectoral minor or the levator scapulae in order to allow for optimal movement of the shoulder blade. This is essential to properly scapular retract and adduct the arm at 90 degrees of elbow flexion in order to stabilize the glenerohumeral joint. Another problem with conventional shoulder rehabilitation apparatus is the failure to allow for scapular depression with resistance of varying intensities in order to stabilize the shoulder joint when placed in a vertical position at 90 degrees of shoulder abduction.

While the numerous devices and apparatus of the prior art may be suitable for the particular purpose to which they address, they are not suitable for individuals to be able to optimize their shoulder range of motion, strength building and stability, nor do they allow for myofascial release techniques to decrease spasm.

SUMMARY OF THE INVENTION

Accordingly, an object of the present invention is to provide an adjustable apparatus to stabilize the shoulder and rotator cuff throughout a variety of active motion activities to thereby overcome the shortcomings of the prior art.

Another object of the present invention is to provide an adjustable apparatus to stabilize the shoulder and rotator cuff so that individuals can optimize their shoulder range of motion, strength and stability while providing for myofascial release techniques to decrease spasm.

Still another object of the present invention is to provide an adjustable apparatus to stabilize the shoulder and rotator cuff in the most optimal position for rotator cuff strengthening.

Yet another object of the present invention is to provide an adjustable apparatus to stabilize the shoulder and rotator cuff while allowing for resisted scapular retraction and shoulder adduction with varying intensities.

Another object of the present invention is to provide an adjustable apparatus to stabilize the shoulder and rotator cuff and to maintain the shoulder at a stabilized position on a variety of planes, by either placing the arm in scapular retraction and adduction by one's side, or by raising the shoulder to 90 degrees of abduction.

Still another object of the present invention is to provide and adjustable apparatus to stabilize the shoulder and rotator cuff while simultaneously providing myofascial release techniques for the chest and neck muscles.

Other objects and advantages of the present invention will become more obvious hereinafter in the specification and drawings.

The invention is directed to an apparatus for stabilizing and strengthening the shoulder and rotator cuff construction. In particular, the apparatus provides for stabilization of the shoulder and rotator cuff to optimize range of motion, strengthening and stability when performing various motion exercises. In addition, the apparatus provides for self myofascial release techniques to decrease muscle spasm.

In accordance with the present invention, an apparatus for use in exercising the shoulder includes a motion assembly having a stacked arrangement of first, second and third stages. The first stage is coupled to the second stage to permit relative one-dimensional straightline motion therebetween. The third stage is coupled to the second stage to permit relative in-plane rotational motion therebetween. The motion assembly further includes means for selectively limiting the relative one-dimensional straightline motion and the relative in-plane rotational motion. A handle is coupled to the third stage and is adapted to be grasped by a user. A base assembly is coupled to the first stage of the motion assembly for positioning the motion assembly at a selected vertical height, a selected pitch position, and a selected yaw position. The base assembly is also equipped to fix the motion assembly in at least its selected vertical height.

In one embodiment, the apparatus includes a base, a vertical post, an adjustable sleeve on the post, an arm adjustably attached to the sleeve, and the motion assembly. The motion assembly includes a bottom plate, a middle plate and top plate. A handle for grasping with either the left hand or right hand, while performing various motion exercises, is adjustably fitted to the top plate. A self myofascial release device removably attaches to the motion assembly.

The base of the apparatus supports the entire structure on a floor surface. The vertical post is attached to the base and allows for adjustment of the height of the motion assembly. The sleeve slides up and down the vertical post and is adapted to be locked at any one of a range of fixed, vertically adjusted positions. The arm adjustably connects to the sleeve and is rotatable relative to the sleeve to orient the motion assembly in any one of a range of adjusted pitch directions. The bottom plate attaches to the arm assembly and is moveably adjusted throughout a range of yaw positions. The yaw position can be fixed or yaw motion can be resisted through the use of one or more elastomeric cords connected to the bottom plate and a cross-bar coupled to the sleeve. Resistance can also be provided between the top plate and the fixed structure on the apparatus. The middle plate slides relative to the bottom plate along its longitudinal axis. This motion can also be resisted by one or more elastomeric cords connecting between the bottom plate and middle plate. The handle on the top plate is grasped in order to perform motion exercises, moving the top plate in either a longitudinal linear direction relative to the bottom plate and/or in a rotating motion. The distance between the handle and the rotational axis of the top plate is adjustable to accommodate for variations in arm lengths of different users. The self myofascial release device includes a padded tip that is mounted at the end of an adjustable arm. Motion of the plate, while grasping the handle, moves the rubber tip against various muscles to relieve spasm.

BRIEF DESCRIPTION OF THE DRAWINGS

Other objects, features and the of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 13:
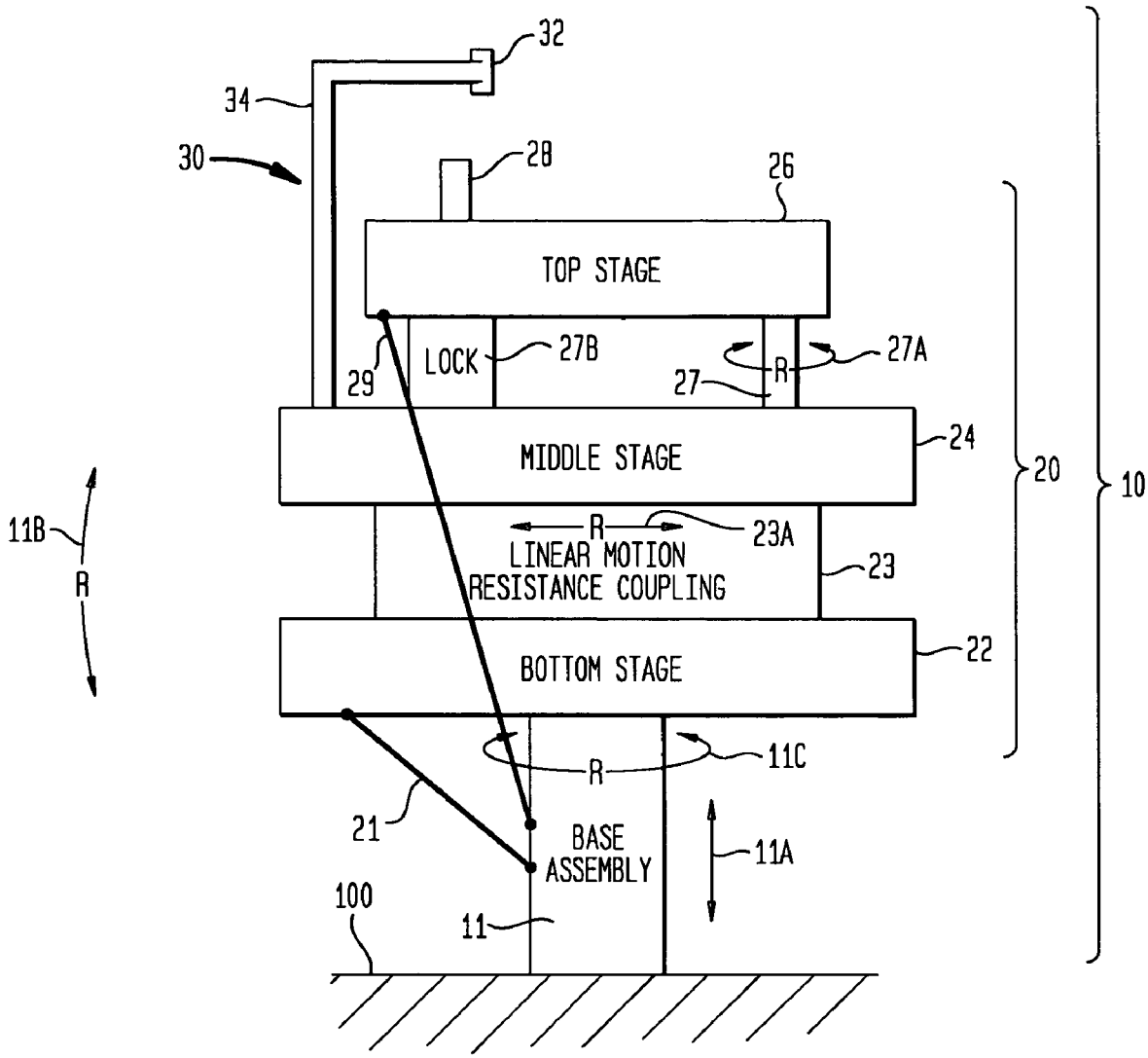
FIG. 13 a schematic view of the apparatus of the present invention.

Referring now to the drawings, FIG. 13 presents a schematic view of a shoulder rehabilitation apparatus (referenced generally by numeral 10) that supports a variety of stabilized shoulder strengthening exercises in accordance with the present invention. Apparatus 10 is adjustable to permit performance of various motion activities, as well as to accommodate individuals of varying height and size. Apparatus 10 is specifically structured to stabilize the shoulder and rotator cuff while simultaneously allowing the individual user to perform a variety of motion exercises (activities). Stabilizing the shoulder and rotator cuff throughout the exercises enables the individual user to optimize their shoulder range of motion and muscle strengthening when performing the exercises. The apparatus can also provide for self myofascial release techniques to decrease muscle spasm.

Apparatus 10 is presented schematically in FIG. 13 to clearly illustrate its novel features. It is to be understood that apparatus 10 could be constructed in a variety of ways by one of ordinary skill in the art without departing from the scope of the present invention. By way of a non-limiting example, one such construction will be shown and described later herein along with a variety of exercises that can be performed therewith.

Apparatus 10 includes a base assembly 11 and a motion assembly 20. Base assembly 11 provides support for motion assembly 20, provides for adjustable positioning of motion assembly 20, and can be used as a point of attachment for motion resistance mechanisms that limit/resist selected movements of some or all of motion assembly 20. Base assembly 11 rests on or is coupled to a stationary surface 100 (e.g., floor, wall, etc.) using any construction that provides support for motion assembly 20 in all of its positions/motions regardless of the size of the user. In general, base assembly 11 provides for the vertical height adjustment of motion assembly 20 (as indicated by two-headed arrow 11A), a pitch angle adjustment of motion assembly 20 (as indicated by two-headed arrow 11B), and a yaw angle adjustment of motion assembly 20 (as indicated by two-headed arrow 11C). Base assembly 11 is equipped to fix each of these three adjustments as needed to support a particular user in a particular exercise. In addition, base assembly 11 is equipped to optionally allow for resisted movement in pitch and/or yaw as indicated in FIG. 13 by the "R" incorporated in pitch adjustment arrow 11B and yaw adjustment arrow 11C. It is to be understood that base assembly 11 can be realized by a variety of constructions without departing from the scope of the present invention.

Motion assembly 20 is a multi-stage assembly that forms the user interface of apparatus 10 and provides for a variety of unresisted and resisted motions to support a wide range of shoulder strengthening exercises. In general, motion assembly 20 has three stages 22, 24, and 26 that are stacked with stage 22 being the base or bottom stage, stage 24 being the middle stage, and stage 26 being the top stage. Bottom stage 22 is coupled to base assembly 11 in a way that allows motion assembly 20 to be adjusted in pitch llB and yaw llC as described above. Bottom stage 22 and middle stage 24 are coupled together by a linear motion resistance coupling 23 that provides for resisted motion along either direction of a single linear dimension indicated by two-headed arrow 23A. That is, coupling 23 allows middle stage 24 to be moved relative to bottom stage 22 linearly in either direction 23A along a plane where such movement is resisted as indicated by the "R" in two-headed direction arrow 23. Typically, the resistance provided by coupling 23 in either direction 23A is resilient so that an "at rest" position is defined between bottom stage 22 and middle stage 24. As mentioned above, movement of motion assembly 20 in pitch 112 and/or yaw llC during an exercise can be achieved with the present invention. If such movement is to be resisted (as indicated by the "R"), a resistance mechanism 21 (e.g., a resilient elastic band or cord, a hydraulic mechanism, etc.) can be coupled between bottom stage 22 and base assembly 11.

Middle stage 24 and top stage 26 are coupled together by a rotational-motion coupling 27 that provides for rotational motion of top stage 26 about coupling 27 and relative to middle stage 24 as indicated by two-headed arrow 27A. Typically, the rotational motion in either direction 27A occurs in a plane that is parallel to the plane in which middle stage 24 moves. As will be explained further below, the rotational motion in either direction 27A can be unresisted or resisted (as indicated by the "R") in a resilient fashion depending on the user's needs and/or exercise being performed. Such resistance can be incorporated into coupling 27 (e.g., by an adjustable resistance mechanism), or could be supplied by an external resistance mechanism. For example, a resistance mechanism 29 (e.g., one exhibiting resilience) can be coupled between top stage 26 and base assembly 11, or between top stage 26 and one of bottom stage 22 or middle stage 24.

Top stage 26 forms the portion of motion assembly 20 that the user will grasp during various exercises. Accordingly, a gripping handle 28 is coupled to top stage 26. The position of handle 28 on top stage 26 can be adjustable to accommodate different sizes of users. Further, since many exercises will require a user's forearm to rest on top stage 26, the surface of top stage 26 could be anatomically shaped, padded, etc., to improve user comfort and/or properly position one's forearm for exercises without departing from the scope of the present invention. Such shaping, padding, etc., can be incorporated into top stage 26 or attached thereto.

For some exercises, it may be desirable to prevent the rotational motion of top stage 26 in direction 27A. Accordingly, coupling 27 can include a locking mechanism (not shown) to prevent rotation. Alternatively, a separate lock 27B can be provided that allows the selective locking or coupling of top stage 26 to middle stage 24.

Motion assembly 20 can optionally include/utilize a self myofascial release device 30 that would be coupled to middle stage 24. In general, device 30 is any adjustable arm 34 (e.g., multi-piece arm, articulating arm, etc.) that is attached on one end thereof to middle stage 24 and has a padded (e.g., rubber, foam, etc.) tip 32 formed/attached to the free end of arm 34. Adjustable arm 34 can be of any construction that permits adjustment of tip 32 such that it remains in place after such adjustment. As will be explained further below, arm 34 is adjusted so that tip 32 applies pressure to a user's selected muscle(s) during a particular exercise in order to relieve muscle spasms that can occur during exercise.

Figure 14:
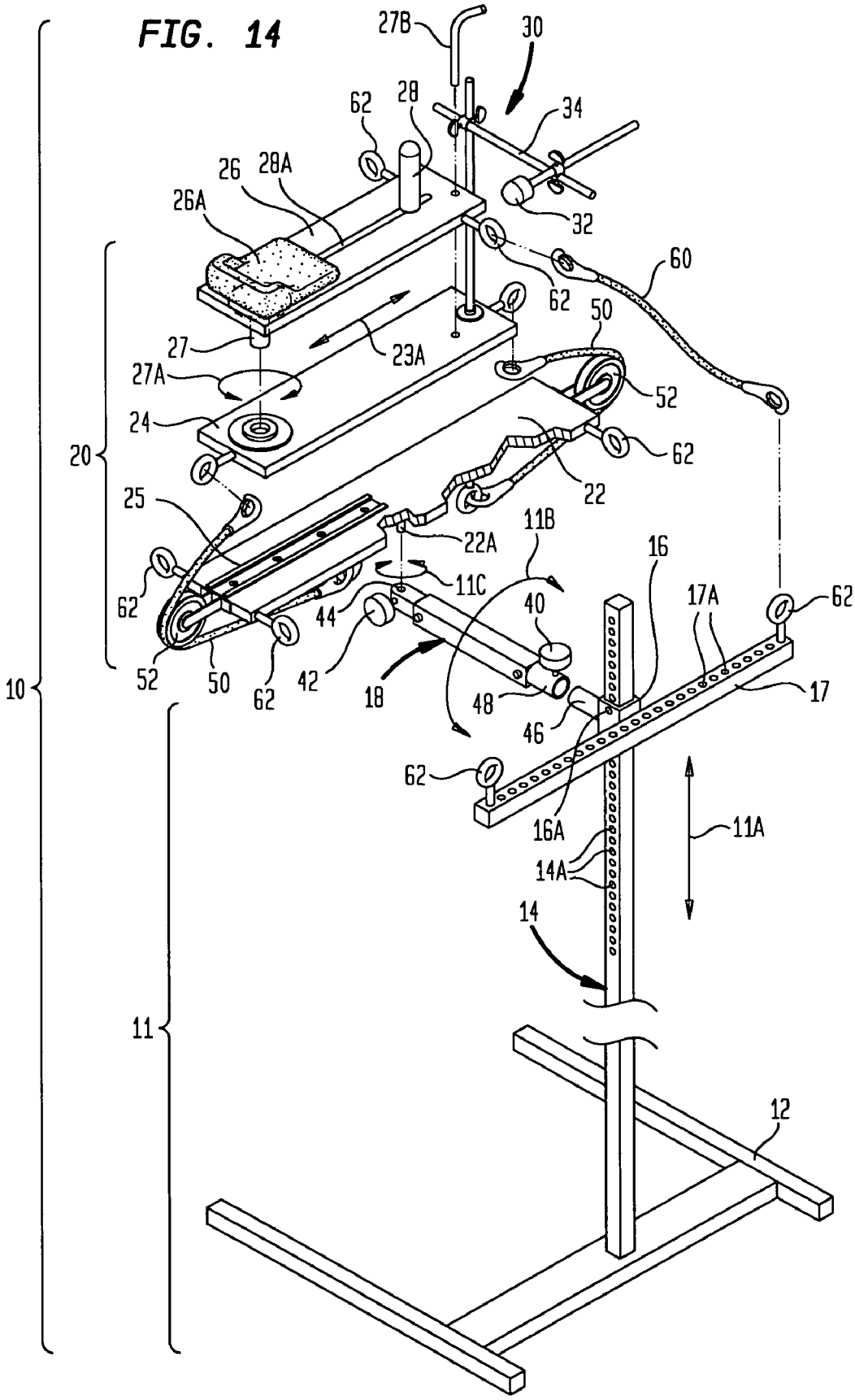
FIG. 14 is a partially exploded, perspective view of an exemplary embodiment of the present invention.

Referring now to FIG. 14, an exemplary and non-limiting realization of apparatus 10 is illustrated. Where possible, FIG. 14 uses the same reference numerals used in the schematic illustration of the present invention (i.e., FIG. 13). Base assembly 11 of apparatus 10 includes a base 12, a vertical post 14, a sleeve 16 slidably adjustable throughout a range of adjusted positions on the vertical post 14, and an arm assembly 18 adjustably fitted to the sleeve 16 so that the arm assembly 18 is moveable with the sleeve throughout the range of vertically adjusted positions.

The base 12 is formed in a U-configuration with opposite parallel legs extending from a central mounting portion to help stabilize and support the entire structure of the apparatus 10 on a floor surface. The vertical post 14 is attached to the central portion of the base 12 and is provided with a series of spaced apertures 14A for adjusted positioning of the sleeve 16 with the use of one or more removable locking pins (not shown) as would be understood in the art. Sleeve 16 slides up and down along the post 14 for height adjustment 11A of the arm assembly 18 and motion assembly 20, and is locked into the adjusted position of the post 14 using removable locking pins (not shown) which pass through correspondingly aligned apertures 16A and 14A on the sleeve 16 and the post 14, respectively. The arm assembly 18 is removably attached to the sleeve by a knob bolt 40 and interconnecting tube sections 46, 48 which are structured to allowed adjustment of the pitch position 11B of the motion assembly 20. A cross-bar 17 is attached to sleeve 16 for movement therewith. Cross-bar 17 is provided with a plurality of apertures 17A along the length thereof that provide attachment points for one or more resistance bands/cords that can be coupled to some portion of motion assembly 20 as will be explained below.

Motion assembly 20 is adjustably fitted to arm assembly 18 and includes a simple plate for each of bottom stage 22, middle stage 24 and top stage 26 where the term "plate will be used for the remainder of the description of this particular embodiment. The top plate 26 is provided with a handle 28 for grasping with either the left hand or right hand to perform motion activities of the respective left or right shoulder. The bottom plate 22 attaches to the arm assembly 18 by a pin 22A fitted into a hole 44 in arm assembly 18 to allow positioning or motion of the bottom plate 22 in the yaw direction 1C. To fix bottom plate 22/motion assembly 20 in yaw, a knob bolt 42 is tightened to engage pin 22A. If bottom plate 22/motion assembly 20 is to move in yaw, knob bolt 42 is left loose or removed.

Resistance to yaw motion of bottom plate 22/motion assembly 20 can be provided by, for example, one or more resilient elastic cords/bands (e.g., an elastomeric band or cord 60) that attach to bottom plate 22 and cross-bar 17 or post 14. Attachment can be facilitated by the use of eye bolts 62 provided on top plate 26/bottom plate 22 and adjustably positioned on post 14 or cross-bar 17. The elasticity of cord 60 and its position on cross-bar 17 (or post 14) are selected based on the amount of resistance needed for a particular user or exercise. Note that the elastic cord's point of attachment on cross-bar 17 or post 14 determines the moment arm for an exercise. If the entirety of motion assembly 20 is to move as one unit in yaw, a lock pin 27B can be used to couple top plate 26 to middle plate 24. However, if only top plate 26 is to rotate, bottom plate 22 is fixed in yaw by knob bolt 42, lock pin 27B is disengaged from middle plate 24, and elastic cord 60 is coupled to top plate 26 and cross-bar 17 or post 14. This allows for selected adjustment of resistance to movement of the top plate 26 when performing various motion exercises. Elastic (e.g., elastomeric) cord 60 may be used to provide increased resistance.

The middle plate 24 slides relative to the bottom plate 22 along a track 25 so that the one-dimensional motion of the middle plate 24 is along the longitudinal axis of the bottom plate 22. This linear motion can be resisted in one or both directions when performing certain motion exercises. For example, one or more elastomeric cords 50 can be used to connect the bottom plate 22 to middle plate 24 about a pulley 52. The handle 28 on the top plate 26 is grasped by the individual user in order to perform the various motion exercises. The distance between the handle 28 and the rotational axis of coupling 27 is adjustable to the arm size of the individual as handle 28 is positioned along a track 28A.

The self myofascial release device 30 is provided with a rubber tip 32 on the end of an adjustable arm 34 that allows the rubber tip to be positioned at the required location to make pressure contact with, for example, the levator scapulae muscles or pectoral minor muscles when a user performs various motion activities. Arm 34 can be adjusted as needed to make proper contact with the requisite amount of pressure to selected muscles(s).

In an exemplary use, the user rests his/her arm on the top plate 26 which can be anatomically shaped/equipped to comfortably support a user's forearm. For example, top plate 26 can include a padded area and/or a cradle 26A for the elbow and the forearm. The height of the motion assembly 20 is adjusted by moving the sleeve 16 up or down along the post 14. When the motion assembly 20 is at the desired height position, the user locks the sleeve 16 into position on the post 14 with removable locking pins (not shown). The pitch orientation 11B of the motion assembly 20 is adjustably fixed into position using the knob 40 on the arm assembly 18. Next, the user moves the top plate 26 and the middle plate 24 forwards or backwards along the rail 25. Then by rotating the bottom plate 22, the user can bring the elbow as close as possible to their side as motion assembly 20 is rotated about its yaw axis. The user can fix the yaw position by tightening knob 42. One or all three motions (i.e., pitch, longitudinal sliding, and yaw) can be fixed or have selectable resistance coupled thereto which may be created with elastomeric cords or other tensioning mechanisms without departing from the scope of the present invention. It is to be understood that set-up of apparatus 10 can occur in a variety of ways without departing from the scope of the present invention. For example, in a different configuration, all three plates (i.e. bottom, middle, top) can be vertically oriented by rotating arm assembly 18 relative to the sleeve 16. The user could then pull down both the top plate 26 and middle plate 24, with selectable resistance against elastomeric cord 50, and perform shoulder rotation by rotating the top plate 26 relative to the bottom plate 22/middle plate 24 with resistance provided by elastomeric cord 60.

As described above, the present invention can be set-up in a variety of ways using base assembly 11 and motion assembly 20. The stacked arrangement of motion assembly 20 provides one or both of sliding and pivoting movements that facilitates proper positioning for stabilizing the shoulder prior to and during exercise thereof. Once in position, the user's movement of some or all of motion assembly 20 can be resisted by one or more resilient members. When needed, myofascial release device 30 can be used to release muscle spasm on each exercise repetition.

By way of example, a series of shoulder motion and strengthening activities are presented in FIGS. 1-12B. Each motion activity is shown using at least a pair of drawing figures with the first drawing in the pair showing a start position and the second drawing figure (labeled with "A") showing a stop position at the end of the full range of motion. After this stop position, the motion is returned back to the original start position. For clarity of illustration, not all elements of apparatus 10 are shown or referenced in each figure.

Figure 1:
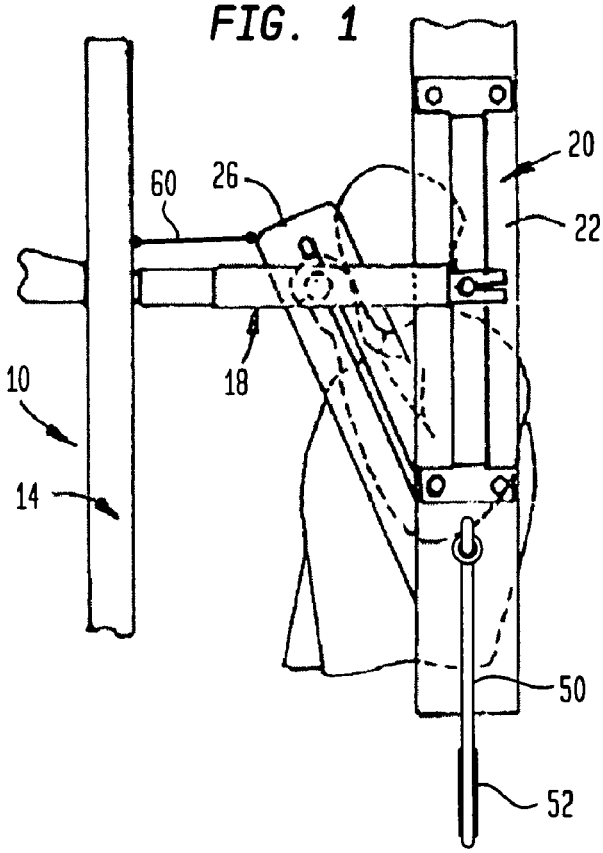
FIGS. 1 and 1A illustrate use of the present invention to perform resisted external rotation (at 90 degrees) of left shoulder abduction along with resisted scapular depression.
Figure 1A:
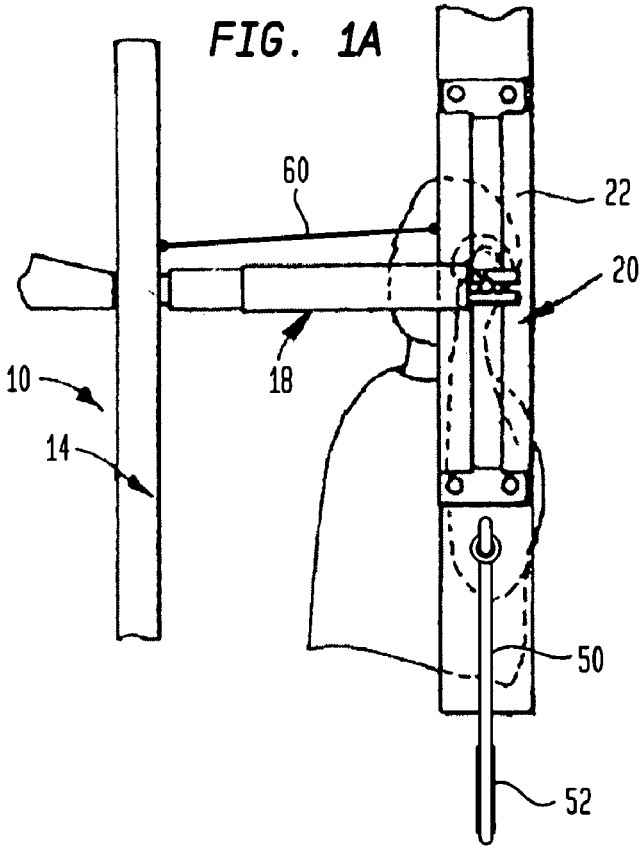

FIGS. 1 and 1A show a sequence of movements of resisted external rotation, at 90 degrees, of the left shoulder with abduction and resisted scapular depression. Motion assembly 20 is vertically oriented in this case. The movement of resisted (provided by elastomeric cord 60) external rotation helps to strengthen the external rotators of the rotator cuff (infraspinatus) along with resisted (provided by elastomeric cord 50) scapular depression which helps to stabilize the head of the humerus in the shoulder joint (glenerohumeral joint). By performing these two activities together, the user achieves optimal stabilization and strengthening of the structures surrounding the shoulder joint.

Figure 2A:
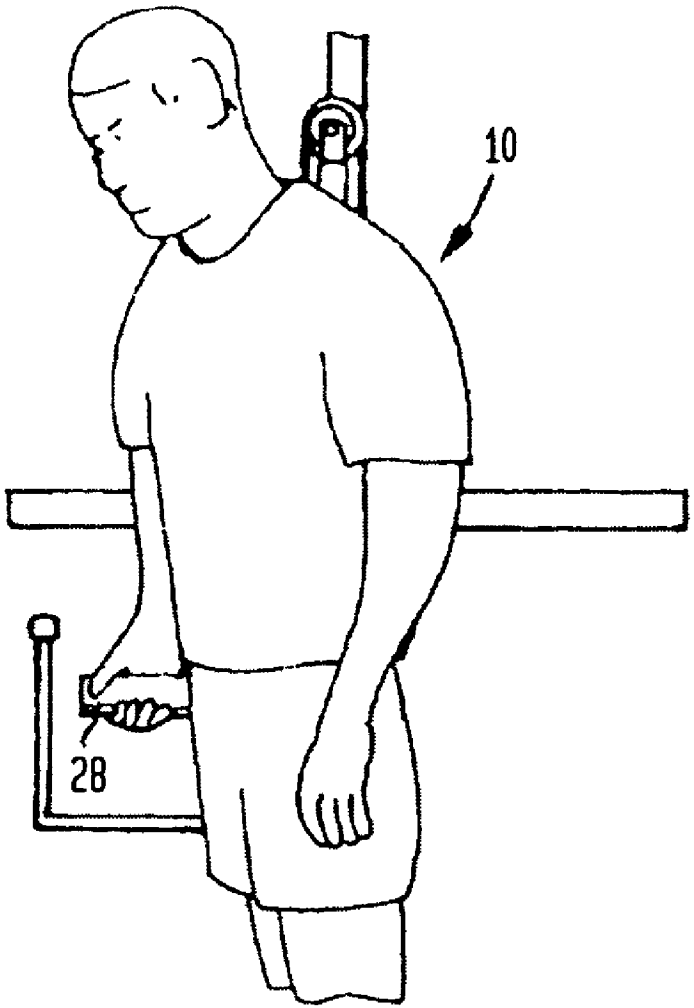
FIGS. 2 and 2A illustrate use of the present invention to perform a vertical row exercise.
Figure 2:
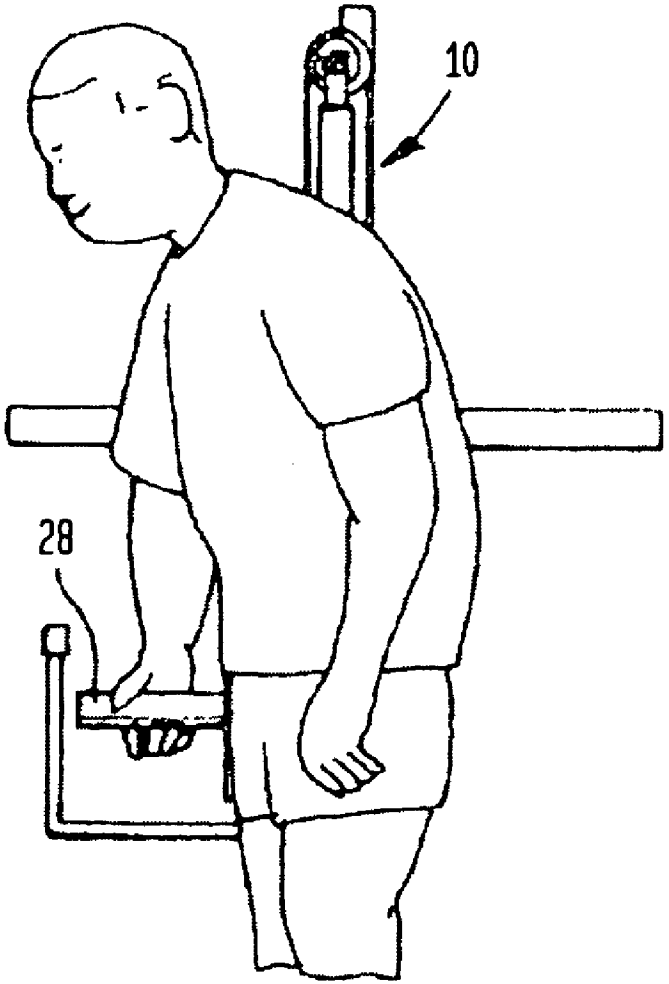

FIGS. 2 and 2A illustrate a sequence of movements for performing a vertical row (i.e., shrug) where motion assembly 20 is again vertically oriented. This movement allows for strengthening of the trapezius muscle that is vital for shoulder stabilization. This movement also provides scapular elevation and active range of motion.

Figure 3A:
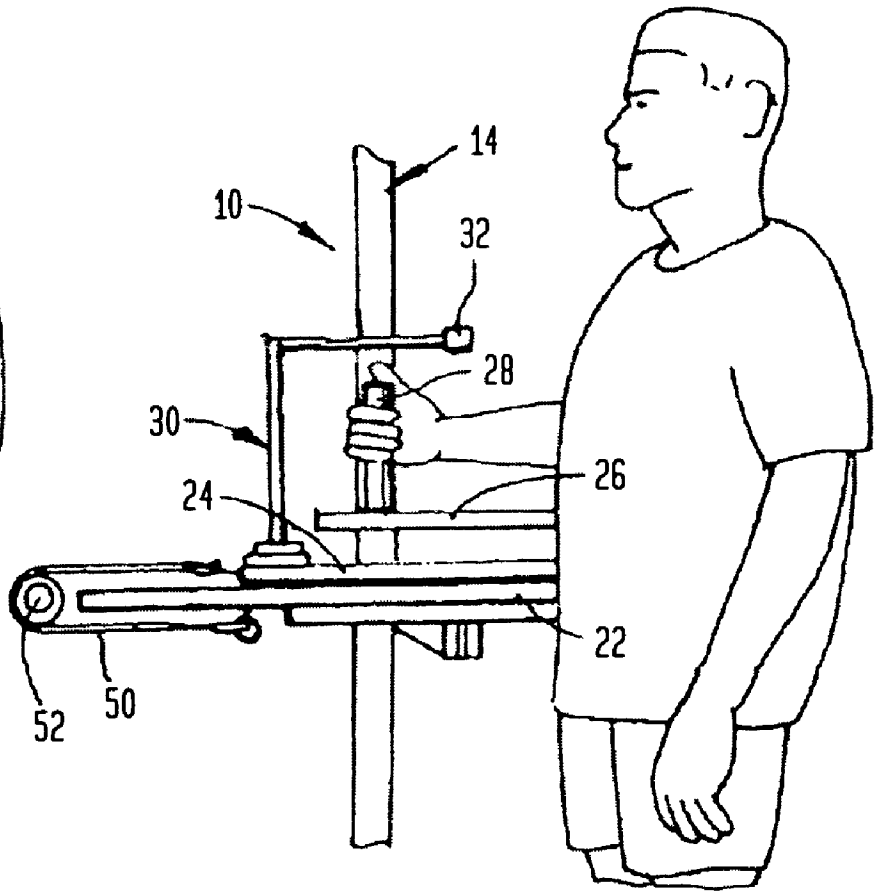
FIGS. 3 and 3A illustrate use of the present invention to perform a resisted neutral grip row with scapular retraction and adduction.
Figure 3:
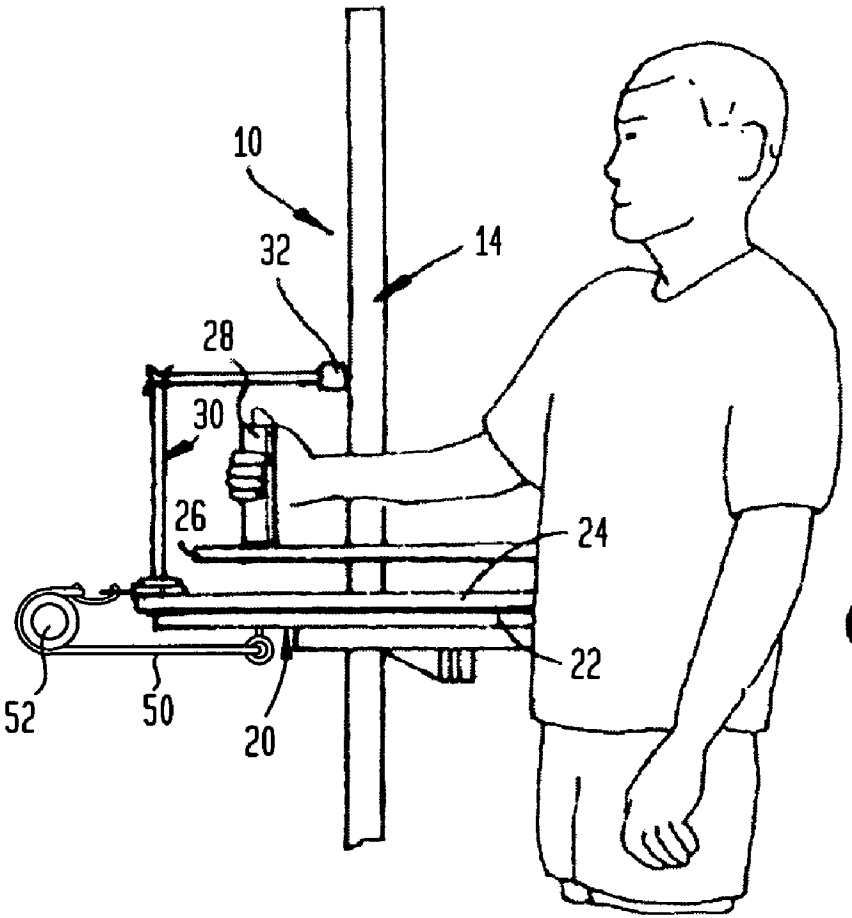

FIGS. 3 and 3A illustrate a sequence of movements for performing a resisted neutral grip row. This activity allows the user to strengthen the stabilizing muscles that surround the shoulder complex. Additionally, this motion activity provides for mobility and range of motion of the shoulder joint, scapula and surrounding musculature.

Figure 4A:
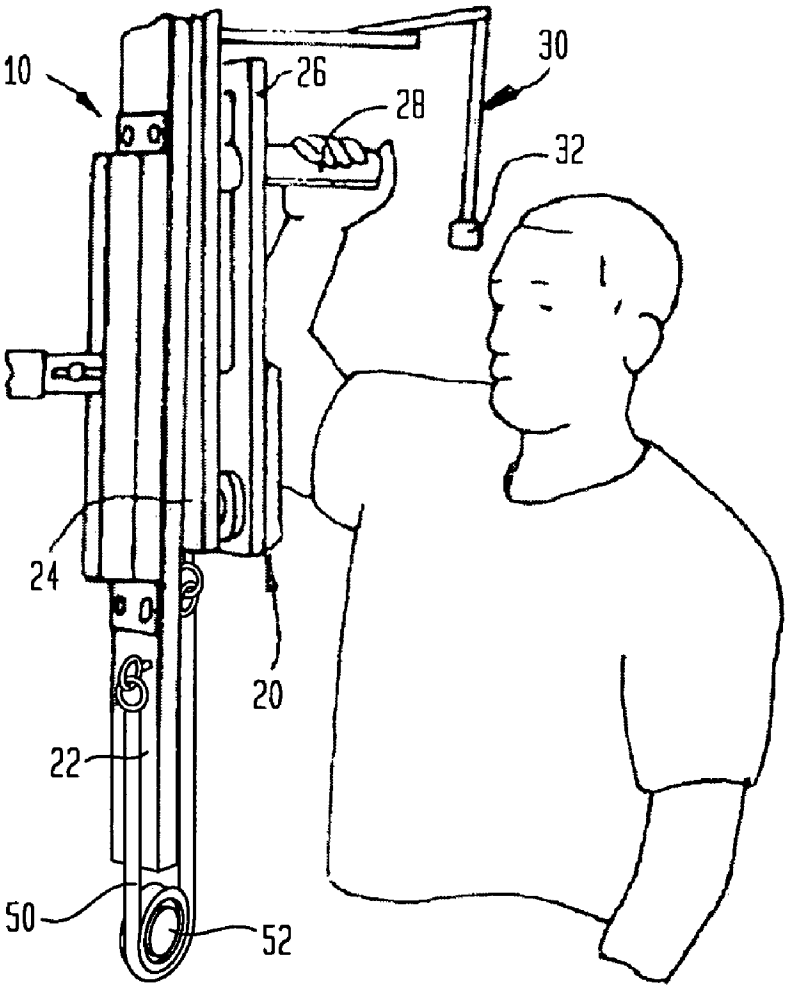
FIGS. 4 and 4A illustrate use of the present invention to perform a neutral grip shoulder press.
Figure 4:
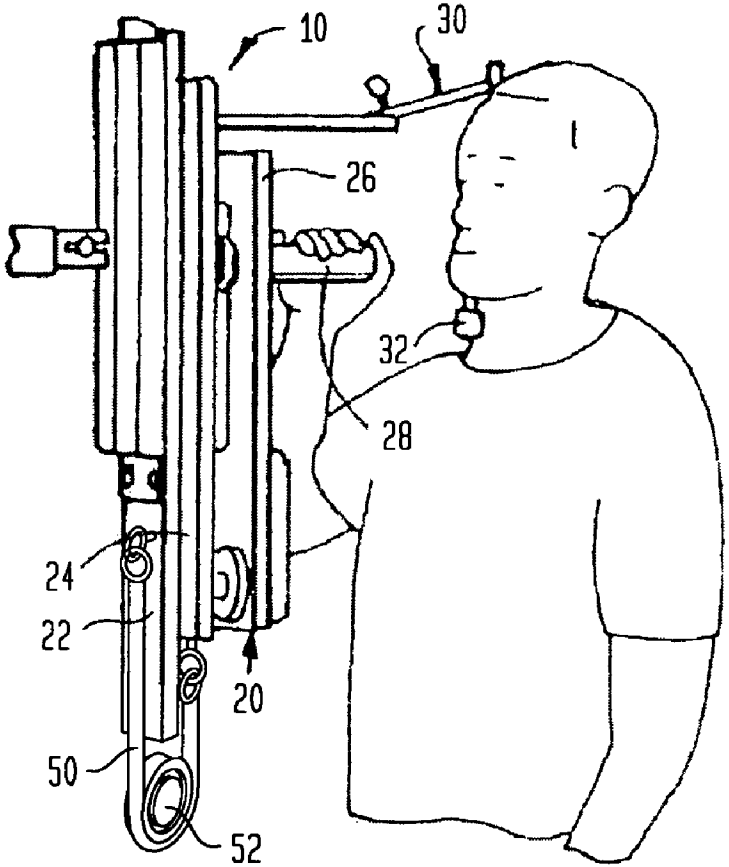

FIGS. 4 and 4A illustrate a sequence of movements of a neutral grip shoulder press. Performing this movement allows the user to safely and effectively strengthen the anterior and medial deltoid muscles with variable resistance provided by elastomeric cord 50.

Figure 5:
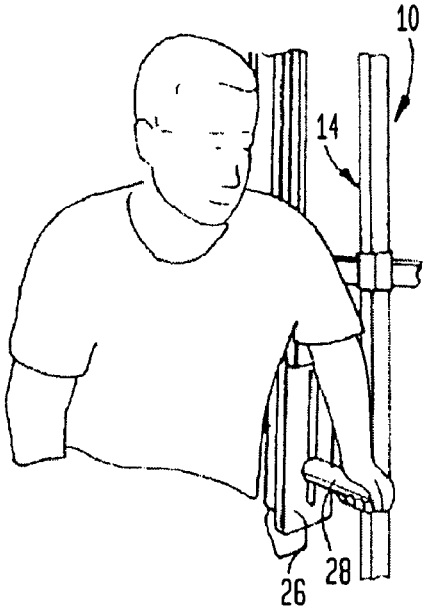
FIGS. 5 and 5A illustrate use of the present invention to perform an abduction active range of motion exercise of the left shoulder.
Figure 5A:
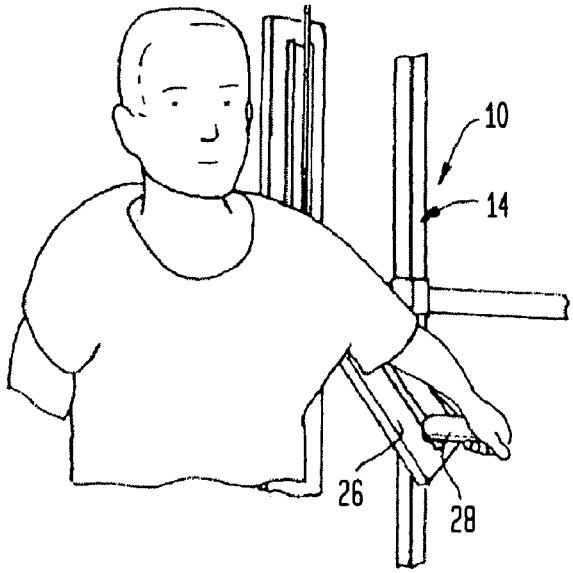

FIGS. 5 and 5A illustrate a sequence of movements in performing an abduction active range of motion exercise of the left shoulder. This movement, which can be resisted or unresisted (as shown), allows the individual to perform left shoulder abduction active range of motion with varying resistance and degrees of range of motion.

Figure 6:
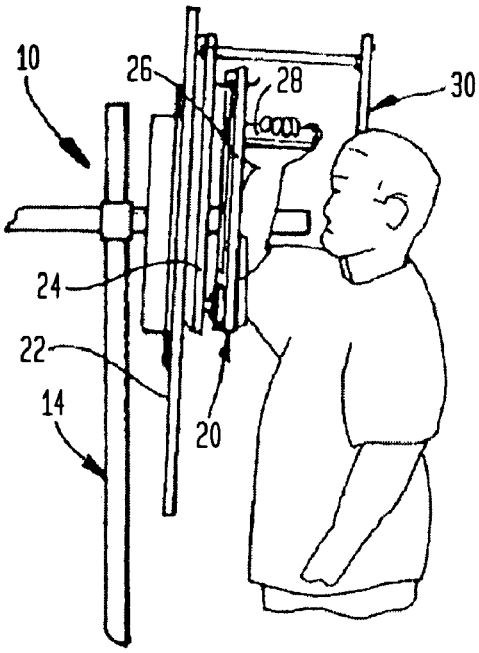
FIGS. 6 and 6A illustrate use of the present invention to perform a self myofascial release activity to the levator scapulae muscles without shoulder abduction.
Figure 6A:
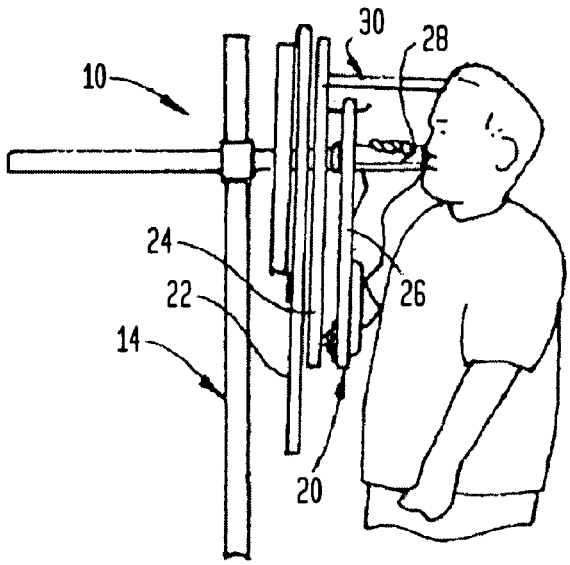
Figure 7A:
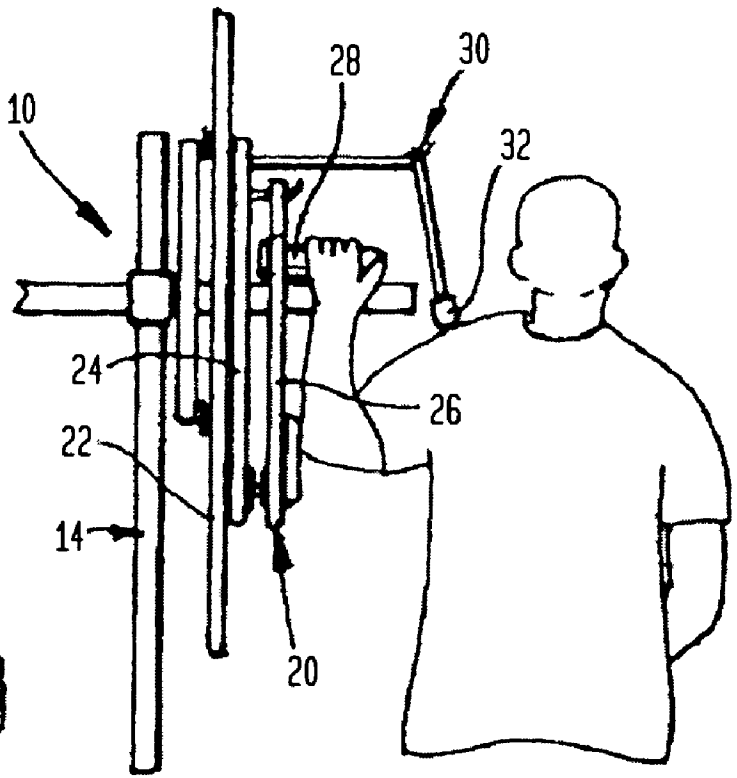
FIGS. 7 and 7A illustrate use of the present invention to perform a self myofascial release activity to the levator scapulae muscles with shoulder abduction.
Figure 7:
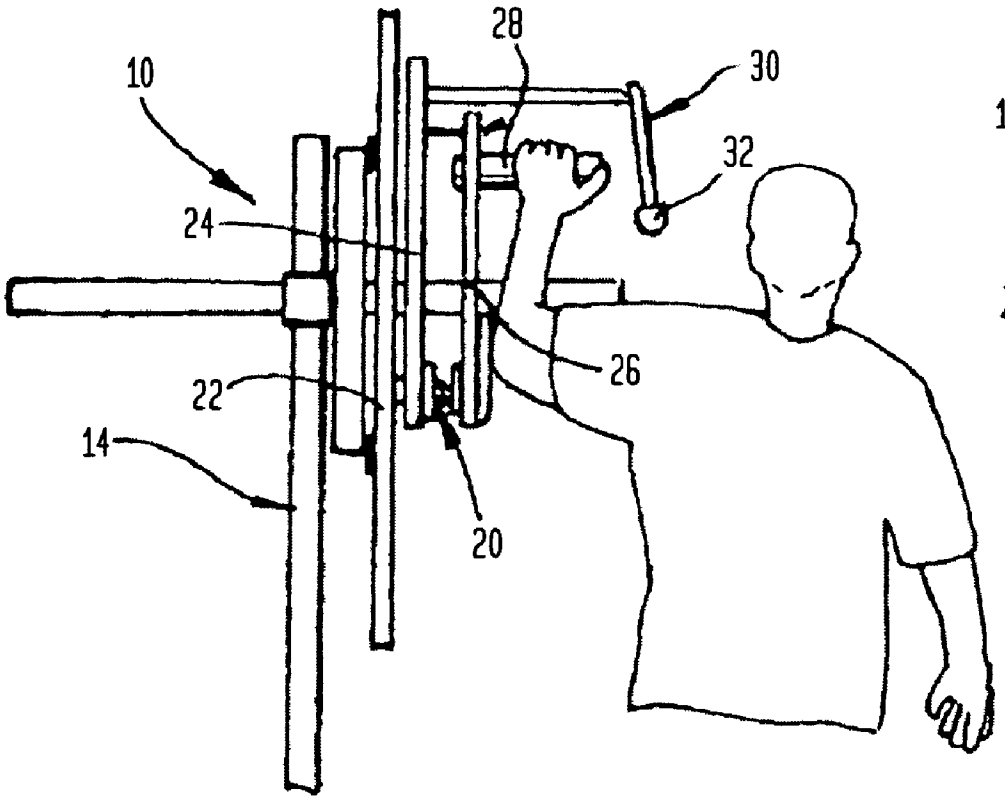

FIGS. 6 and 6A illustrate a sequence of movements in performing a self myofascial release (SMR) activity to the levator scapulae muscles using a neutral grip with no shoulder abduction. Elastomeric cords 50/pulleys 52 have been omitted for clarity of illustration in FIGS. 6, 6A, 7 and 7A, but is to be understood that they supply the resistance for these movements. By performing an SMR activity to the levator scapulae muscles, the individual is able to relieve the levator muscles of any tension or tightness that may exist, along with allowing the shoulder blade the ability to return to a resting position. FIGS. 7 and 7A also illustrate a sequence of movements in performing a self myofascial release (SMR) activity to the levator scapulae muscles with 90° of shoulder abduction. Both SMR activities shown in FIGS. 6/6A and 7/7A decrease tension in the cervical spine and cervical musculature along with providing increased range of motion to the shoulder blade, which is essential for optimal functioning of the shoulder joint.

Figure 8A:
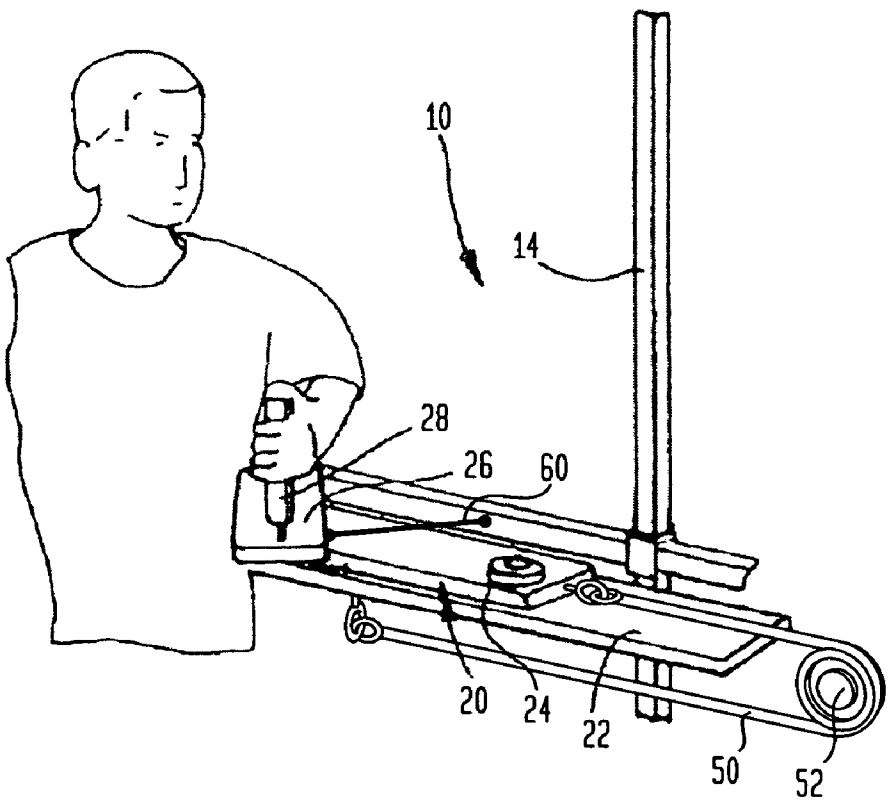
FIGS. 8 and 8A illustrate use of the present invention to perform a resisted scapular retraction with resisted shoulder internal rotation activity.
Figure 8:
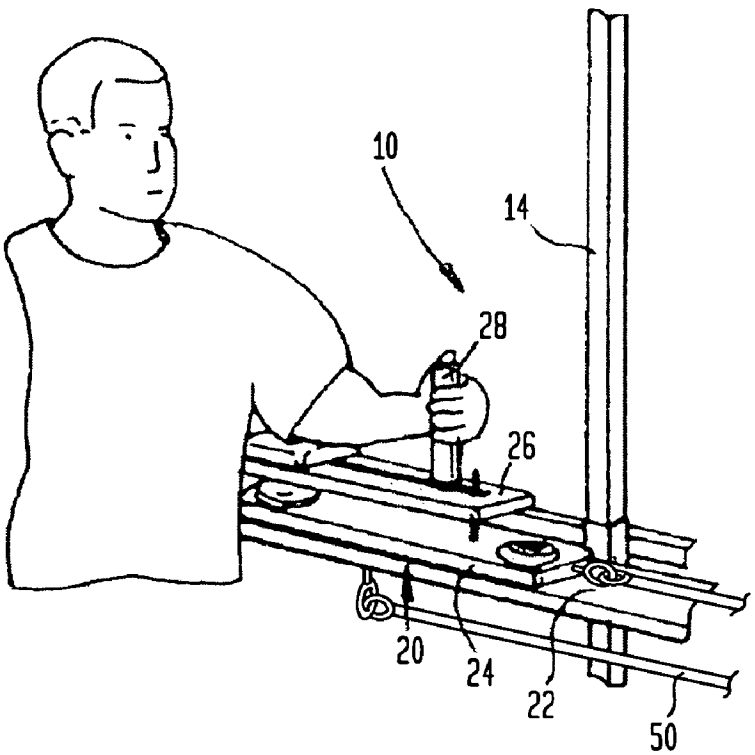

FIGS. 8 and 8A illustrate a sequence of movements in performing a resisted scapular retraction with resisted shoulder internal rotation. Resisted scapular retraction is performed as the user pulls his elbow (from the position illustrated in FIG. 8) towards his body thereby causing middle plate 24 to slide one-dimensionally relative to bottom plate 22 as elastomeric cord 50 is tensioned. Resisted shoulder internal rotation is then performed as the user rotates his hand towards his body (as illustrated in FIG. 8A) thereby causing top plate 26 to rotate relative to middle plate 24/bottom plate 22 as elastomeric cord 60 is tensioned. These two movements allow strengthening of the rotator cuff (subscapularis) muscles. Resisted scapular retraction allows for the proper alignment of the shoulder joint, thus providing optimal shoulder orientation for strengthening of the rotator cuff with resisted internal rotation activities.

Figure 9A:
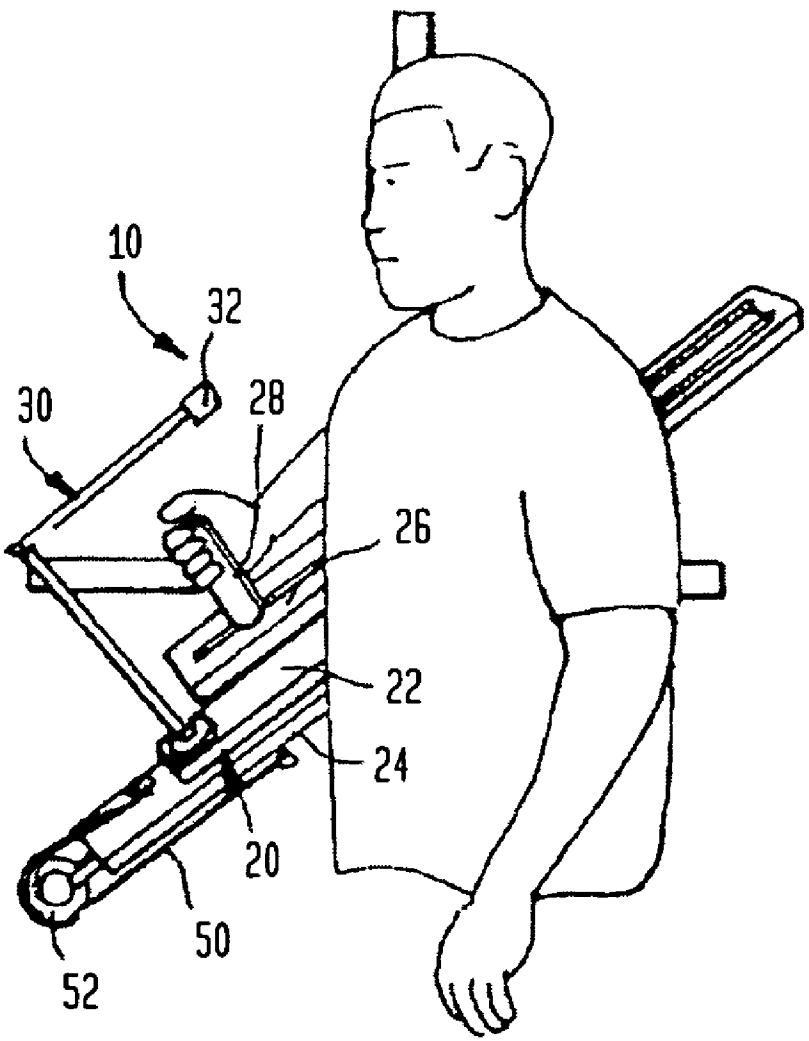
FIGS. 9 and 9A illustrate use of the present invention to perform a resisted row with scapular retraction at a reverse incline.
Figure 9:
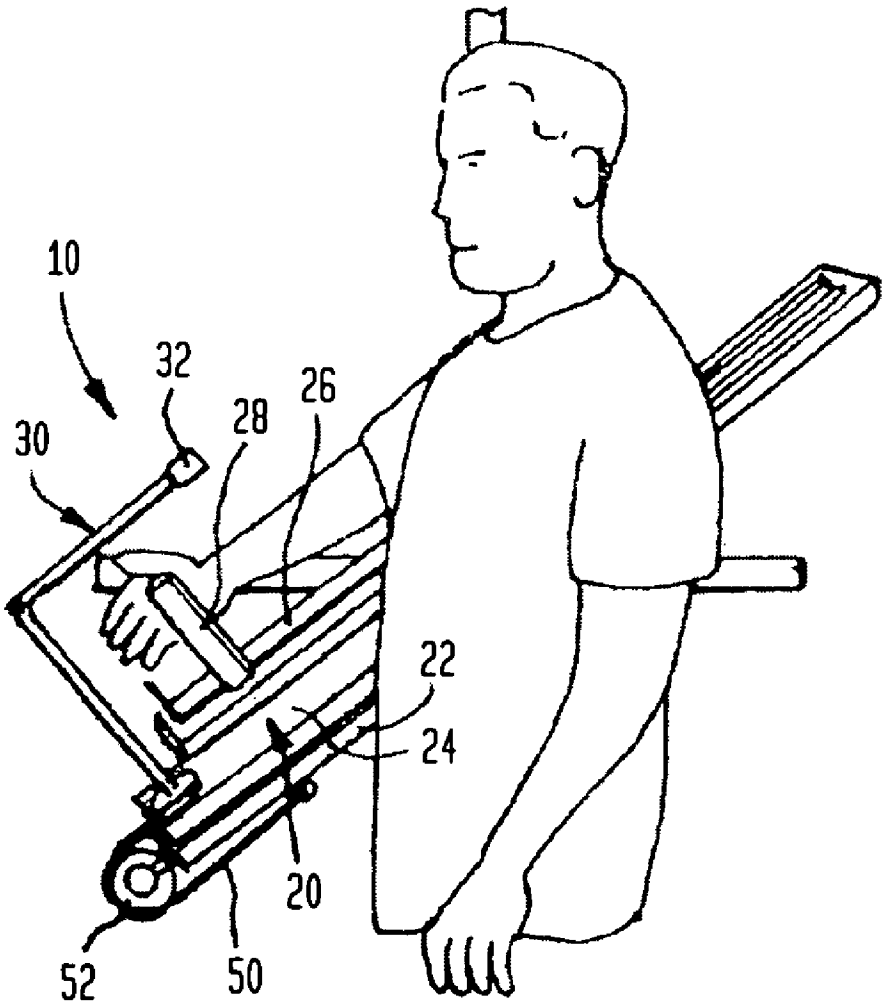
Figure 10:
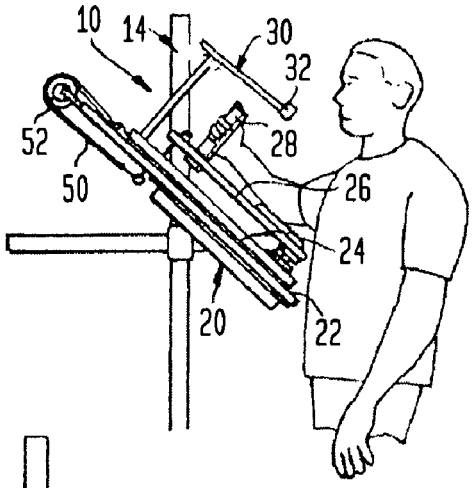
FIGS. 10 and 10A illustrate use of the present invention to perform a resisted row with a scapular retraction at a reverse decline.
Figure 10A:
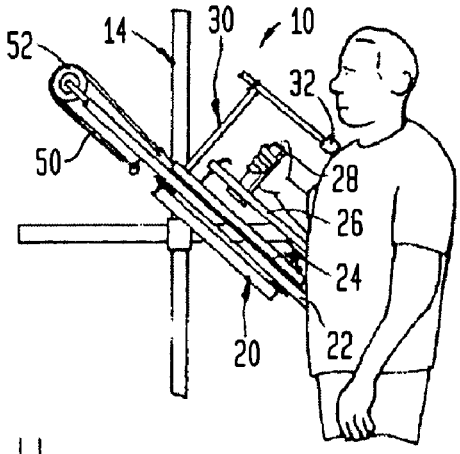

FIGS. 9 and 9A illustrate a sequence of movements in performing a resisted row with scapular retraction with a reverse incline as motion assembly 20 is canted at a downward pitch angle. FIGS. 10 and 10A illustrate a sequence of movements in performing a resisted row with scapular retraction at a reverse decline. Both of these movements illustrate the extreme flexibility and variability of apparatus 10 since the scapular stabilizing muscles can be further strengthened with resisted rowing and scapular retraction activities while the arm and shoulder are positioned at varying angles. This allows the user to strengthen the shoulder complex and surrounding structure throughout the shoulder and rotator cuff's full functional capacity and active ranges of motion. Further, apparatus 10 is configured in FIG. 10A so that SMR device 30 performs SMR on the user's pectoral minor muscles.

Figure 11:
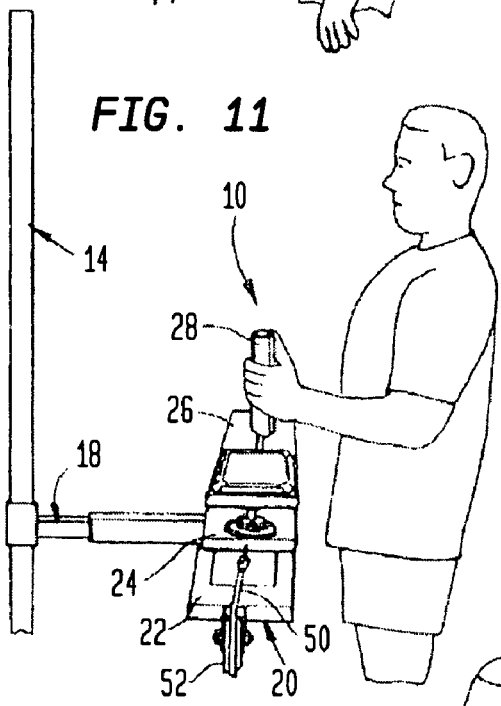
FIGS. 11 through 11B illustrate the present invention to perform a single arm press and single arm row.
Figure 11A:
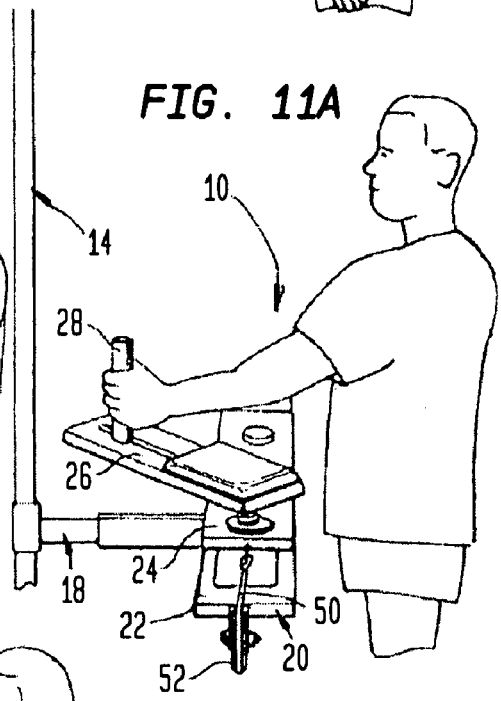
Figure 11B:
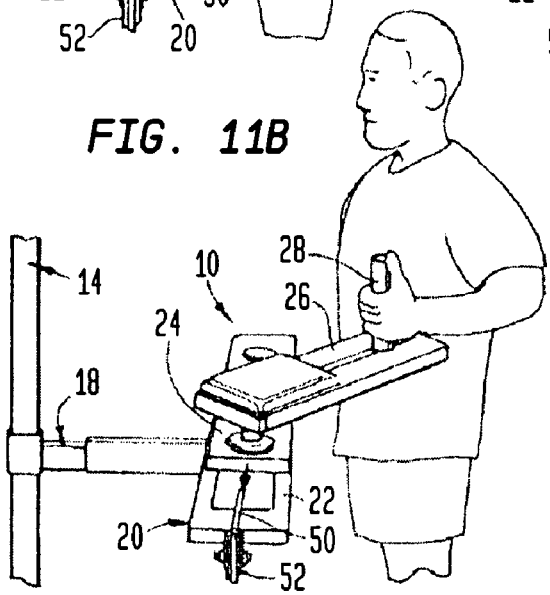

FIGS. 11 and 11A illustrate a sequence of movements in performing a single arm press (FIG. 11A) and a single arm row (FIG. 11B). These motions can be performed with resistance using elastic cords (not shown in FIGS. 11-11B) or can be performed without resistance (as illustrated). All of these motions help to stabilize and strengthen the shoulder joint particularly when they are performed with resistance.

Figure 12:
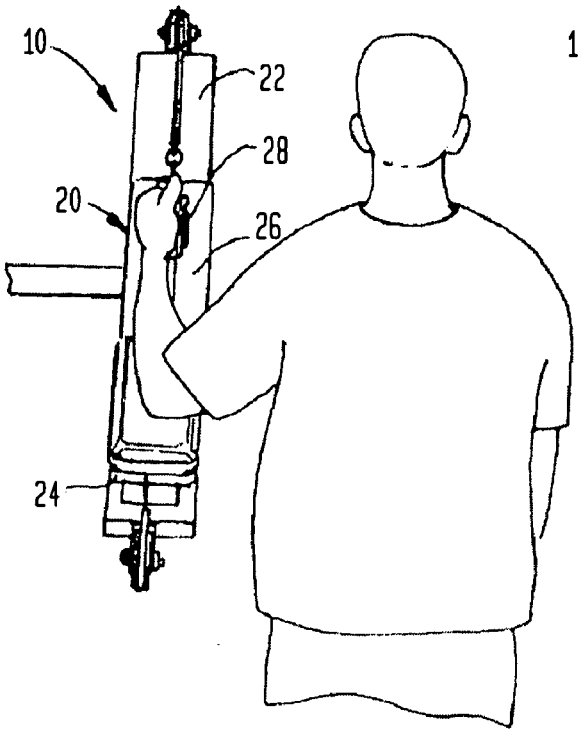
FIGS. 12 through 12B illustrate use of the present invention to perform scapular depression with internal and external rotation at a 75 degree incline.
Figure 12A:
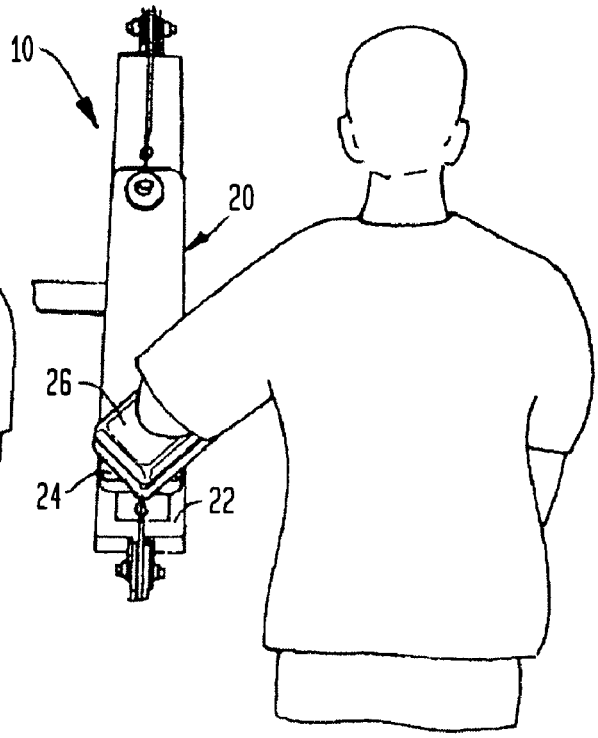
Figure 12B:
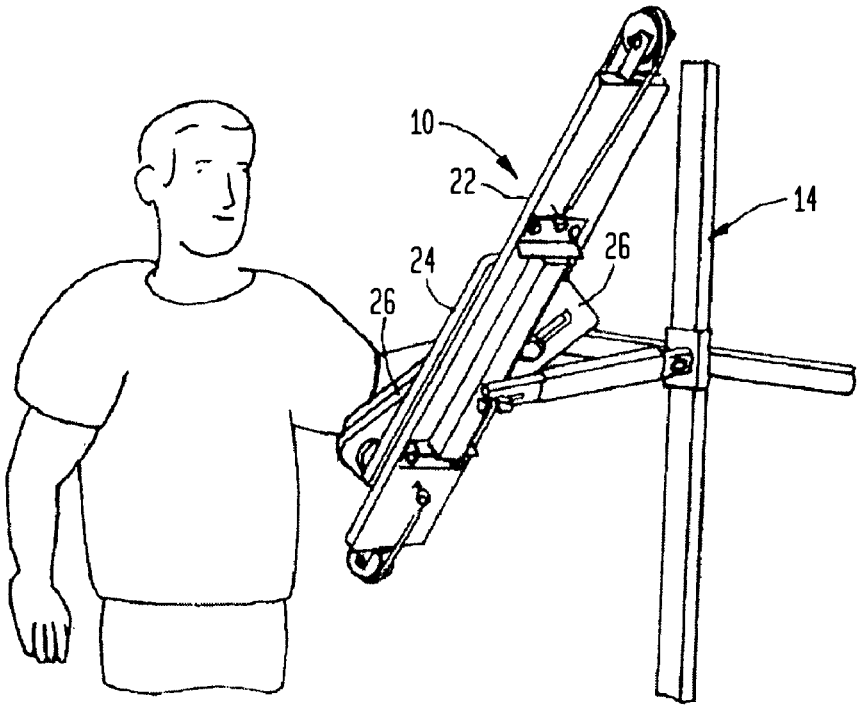

FIGS. 12 through 12B illustrate a sequence of movements to perform a resisted scapular depression (FIG. 12) with resisted internal (FIG. 12A) and external (FIG. 12B) rotation at approximately a 75 degree incline. In this example, the internal and external rotations are shown without resistance. The first motion is beneficial because it allows the user to depress the shoulder blade (scapula) with resistance (i.e., using elastomeric cords 50) or without resistance (i.e., removing elastomeric cords 50). With depression of the shoulder blade, the shoulder joint is able to optimally glide and spin as a ball and socket joint. With resisted scapular depression, the user is able to properly and safely strengthen the muscles that are needed for maintaining the shoulder blade in its proper position for optimal joint function. Resisted scapular depression will also allow decreased tension to the cervical spine, as well as the cervical musculature.

Although the invention has been described relative to a specific embodiment thereof, there are numerous variations and modifications that will be readily apparent to those skilled in the art in light of the above teachings. For example, resistance to the various movements of the present invention can be provided by simple elastic cords/bands, but could also be provided by adjustable spring or hydraulic devices. It is therefore to be understood that, within the scope of the appended claims, the invention may be practiced other than as specifically described.

What is claimed as new and desired to be secured by Letters Patent of the United States is:

1. An apparatus for use in exercising the shoulder, comprising:

a motion assembly having a stacked arrangement of first, second and third stages with (i) said first stage being coupled to said second stage to permit relative one-dimensional straightline motion therebetween, and (ii) said third stage being coupled to said second stage to permit relative in-plane rotational motion therebetween, said motion assembly further including means for selectively limiting said relative one-dimensional straightline motion and said relative in-plane rotational motion;

an arm having first and second ends, said first end being coupled to said second stage of said motion assembly, and said second end being adjustably positioned relative to said first end;

means for padding said second end;

a handle coupled to said third stage and adapted to be grasped by a user; and a base assembly coupled to said first stage of said motion assembly for positioning said motion assembly at a selected vertical height, a selected pitch position, and a selected yaw position, and for fixing said motion assembly in at least said selected vertical height.

2. An apparatus as in claim 1 further comprising at least one resistance means coupled between said base assembly and said motion assembly for imparting a resistance to movement of at least a portion of said motion assembly relative to said base assembly.

3. An apparatus as in claim 2 wherein said resistance means is resilient.

4. An apparatus as in claim 1 wherein said means for selectively limiting comprises at least one of (i) means for fixedly coupling said first stage to said second stage, (ii) means for fixedly coupling said second stage to said third stage, and (iii) means for resiliently coupling said first stage to said second stage.

5. An apparatus as in claim 4 wherein said means for resiliently coupling said first stage to said second stage comprises first and second resilient elements for imparting resistance to opposing directions of said relative one-dimensional straightline motion.

6. An apparatus as in claim 1 further comprising anatomical means coupled to said third stage and adapted to support at least a portion of a user's arm as said handle is grasped by the user.

7. An apparatus for use in exercising the shoulder, comprising:

a motion assembly having a stacked arrangement of first, second and third stages with (i) said first stage being coupled to said second stage to permit relative one-dimensional straightline motion therebetween in a first plane, and (ii) said third stage being coupled to said second stage to permit relative in-plane rotational motion therebetween in a second plane that is parallel to said first plane, said motion assembly further including means for selectively limiting said relative one-dimensional straightline motion and said relative in-plane rotational motion;

an arm having first and second ends, said first end being coupled to said second stage of said motion assembly, and said second end being padded and adjustably positioned relative to said first end;

a handle coupled to said third stage and adapted to be grasped by a user; and a base assembly coupled to said first stage of said motion assembly for positioning said motion assembly at a selected vertical height, a selected pitch position, and a selected yaw position, and for fixing said motion assembly in at least said selected vertical height.

8. An apparatus as in claim 7 further comprising at least one resistance means coupled between said base assembly and said motion assembly for imparting a resistance to movement of at least a portion of said motion assembly relative to said base assembly.

9. An apparatus as in claim 8 wherein said resistance means is resilient.

10. An apparatus as in claim 7 wherein said means for selectively limiting comprises at least one of (i) means for fixedly coupling said first stage to said second stage, (ii) means for fixedly coupling said second stage to said third stage, and (iii) means for resiliently coupling said first stage to said second stage.

11. An apparatus as in claim 10 wherein said means for resiliently coupling said first stage to said second stage comprises first and second resilient elements for imparting resistance to opposing directions of said relative one-dimensional straightline motion.

12. An apparatus as in claim 7 further comprising anatomical means coupled to said third stage and adapted to support at least a portion of a user's arm as said handle is grasped by the user.

13. An apparatus for use in exercising the shoulder, comprising:

a motion assembly having a stacked arrangement of first, second and third stages with (i) said first stage being coupled to said second stage to permit relative one-dimensional straightline motion therebetween, and (ii) said third stage being coupled to said second stage to permit relative in-plane rotational motion therebetween, said motion assembly further including means for selectively limiting said relative one-dimensional straightline motion and said relative in-plane rotational motion;

an arm having first and second ends, said first end being coupled to said second stage of said motion assembly, and said second end being adjustably positioned relative to said first end;

means for padding said second end;

a handle coupled to said third stage and adapted to be grasped by a user;

a base assembly having a stationary portion and a mounting portion coupled to said stationary portion at a selected vertical height, said mounting portion coupled to said first stage of said motion assembly for supporting positioning of said motion assembly at a selected pitch position and a selected yaw position; and at least one resistance means coupled between said mounting portion and said motion assembly for imparting a resistance to movement of at least a portion of said motion assembly relative to said base assembly.

14. An apparatus as in claim 13 wherein said resistance means is resilient.

15. An apparatus as in claim 13 wherein said means for selectively limiting comprises at least one of (i) means for fixedly coupling said first stage to said second stage, (ii) means for fixedly coupling said second stage to said third stage, and (iii) means for resiliently coupling said first stage to said second stage.

16. An apparatus as in claim 15 wherein said means for resiliently coupling said first stage to said second stage comprises first and second resilient elements for imparting resistance to opposing directions of said relative one-dimensional straightline motion.

17. An apparatus as in claim 13 further comprising anatomical means coupled to said third stage and adapted to support at least a portion of a user's arm as said handle is grasped by the user.

18. An apparatus as in claim 13 wherein said mounting portion includes a cross-bar defining a plurality of attachment points for said resistance means.

19. An apparatus for use in exercising the shoulder, comprising:

a motion assembly having a stacked arrangement of first, second and third stages with (i) said first stage being coupled to said second stage to permit relative one-dimensional straightline motion therebetween, and (ii) said third stage being coupled to said second stage to permit relative in-plane rotational motion therebetween, said motion assembly further including means for selectively limiting said relative one-dimensional straightline motion and said relative in-plane rotational motion, wherein said means for selectively limiting comprises at least one of (i) means for fixedly coupling said first stage to said second stage, (ii) means for fixedly coupling said second stage to said third stage, and (iii) means for resiliently coupling said first stage to said second stage, and wherein said means for resiliently coupling said first stage to said second stage comprises first and second resilient elements for imparting resistance to opposing directions of said relative one-dimensional straightline motion;

a handle coupled to said third stage and adapted to be grasped by a user; and a base assembly coupled to said first stage of said motion assembly for positioning said motion assembly at a selected vertical height, a selected pitch position, and a selected yaw position, and for fixing said motion assembly in at least said selected vertical height.

20. An apparatus for use in exercising the shoulder, comprising:

a motion assembly having a stacked arrangement of first, second and third stages with (i) said first stage being coupled to said second stage to permit relative one-dimensional straightline motion therebetween, and (ii) said third stage being coupled to said second stage to permit relative in-plane rotational motion therebetween, said motion assembly further including means for selectively limiting said relative one-dimensional straightline motion and said relative in-plane rotational motion, wherein said means for selectively limiting comprises at least one of (i) means for fixedly coupling said first stage to said second stage, (ii) means for fixedly coupling said second stage to said third stage, and (iii) means for resiliently coupling said first stage to said second stage, and wherein said means for resiliently coupling said first stage to said second stage comprises first and second resilient elements for imparting resistance to opposing directions of said relative one-dimensional straightline motion;

a handle coupled to said third stage and adapted to be grasped by a user;

a base assembly having a stationary portion and a mounting portion coupled to said stationary portion at a selected vertical height, said mounting portion coupled to said first stage of said motion assembly for supporting positioning of said motion assembly at a selected pitch position and a selected yaw position; and at least one resistance means coupled between said mounting portion and said motion assembly for imparting a resistance to movement of at least a portion of said motion assembly relative to said base assembly.

* * * * *